US006948477B2

(12) United States Patent
Tsuyuguchi

(10) Patent No.: US 6,948,477 B2
(45) Date of Patent: Sep. 27, 2005

(54) IDLE SPEED CONTROL DEVICE

(75) Inventor: Makoto Tsuyuguchi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/947,199

(22) Filed: Sep. 23, 2004

(65) Prior Publication Data

US 2005/0092291 A1 May 5, 2005

(30) Foreign Application Priority Data

Sep. 30, 2003 (JP) ..... 2003-340002

(51) Int. Cl.[7] ..... F01D 41/00
(52) U.S. Cl. ..... 123/339.19; 123/339.2
(58) Field of Search ..... 123/339.19, 339.2, 123/339.21, 399.22, 339.23, 339.24

(56) References Cited

U.S. PATENT DOCUMENTS 5,813,386 A * 9/1998 Okada et al. ..... 123/339.14
5,896,839 A * 4/1999 Togai ..... 123/295
5,975,044 A * 11/1999 Kamura et al. ..... 123/295
6,003,489 A * 12/1999 Kamura et al. ..... 123/305
6,009,851 A * 1/2000 Iida et al. ..... 123/339.12

FOREIGN PATENT DOCUMENTS

JP 2000-45835 A 2/2000
JP 2002-106387 A 4/2002

* cited by examiner

*Primary Examiner*—John T. Kwon
(74) *Attorney, Agent, or Firm*—Birch Stewart Kolasch & Birch LLP

(57) ABSTRACT

An idle speed control device for smoothly executing a transition from an idle state where engine speed is feedback controlled to a non-idling state where open-loop control is employed. The device includes an idling state determination section for determining whether the engine is in an idling state or a non-idling state, a feedback control section for controlling an idling control valve so that the engine rotation speed matches a target value in the idling state, a valve opening amount maintaining section for, when shifting from the idling state to a non-idling state, maintaining the idling control valve at the opening amount at the time of feedback control until the throttle opening amount reaches a reference opening amount, and an open loop control section for controlling the idling control valve to the target valve opening amount open if the throttle opening amount reaches the reference opening amount in the non-idling state.

11 Claims, 6 Drawing Sheets

IDLE SPEED CONTROL DEVICE

CROSS-REFERENCE TO RELATED APPLICATIONS

The present application is related to Japanese Patent Application No. 2003-340002, filed on Sep. 30, 2003, the entire contents thereof are hereby incorporated by reference.

BACKGROUND OF THE INVENTION

1. Field of the Invention

The present invention relates to an idle speed control device for control engine rotation speed to a target value in an idling state, and particularly to an idle speed control device where feedback control is selected in an idling state, and open loop control is selected in a non-idling state.

2. Description of Background Art

An idle speed control device provided with a bypass passage for bypassing a throttle valve connected to an intake pipe and an idling control valve (idle air control valve IACV) for controlling opening amount of the bypass passage, for adjusting the IACV based on engine parameters such as engine cooling water temperature and engine rotation speed, in order to control engine rotation speed to a target value in an idling state, is disclosed in Japanese patent application No. 2000-45835, and Japanese patent application No. 2002-106387.

In Japanese patent application No. 2002-106387, in order to control IACV opening amount to an appropriate value, feedback control is adopted in an idling state and open loop control is adopted in a non-idling state. Also, when shifting from an idling state to a non-idling state, in order to relieve a phenomenon of engine blowing caused by sudden reduction in intake air amount, as shown in FIG. 6, technology to cause a gradual reduction in intake air amount is disclosed.

The fact that there has been a shift from an idling state to a non-idling state, as also shown in FIG. 6, is often determined based on whether or not throttle opening amount θ th has exceeded a reference opening amount θ ref, and this reference opening amount θ ref is set to an extremely low opening amount. Accordingly, immediately after shifting from an idling state to a non-idling state, intake air amount supplied through the throttle valve remains reduced and the proportion of intake air through the bypass passage of the entire intake air amount is large. As a result, if a difference between intake air amount calculated in feedback control and intake air amount calculated in open loop control is large, there is a possibility that a transition from an idling state where engine speed is feedback-controlled to a non-idling state where engine speed is open-loop controlled will not be carried out smoothly, even if the rate reduction in intake air amount is gradual at the time of the transition.

SUMMARY AND OBJECTS OF THE INVENTION

The object of the present invention is to solve the above described problems of the related art, and to provide an idle speed control device that can smoothly execute a transition from an idle state where engine speed is feedback-controlled to a non-idling state where open-loop control is employed.

In order to achieve the above described object, the present invention is directed to an idle speed control device, for controlling rotational speed of an engine in an idling state to a target value, comprising a bypass passage for bypassing a throttle valve, an idle control valve provided in the bypass passage, a throttle opening amount sensor for detecting throttle opening amount, and control means for controlling opening amount of the idling control valve, in which the control means is provided with the following means.

(1) means for determining whether the engine is in an idling state of a non-idling state (2) means for obtaining a target speed for engine rotational speed in the idling state (3) means for obtaining a target valve opening amount for the idling control valve in the non-idling state (4) feedback control means for controlling the idling control valve so that the engine rotation speed matches the target value in the idling state (5) valve opening amount maintaining means for, when shifting from the idling state to a non-idling state, maintaining the idling control valve at the opening amount at the time of feedback control until the throttle opening amount reaches a specified reference opening amount (θ ref2), and (6) open loop control means for controlling the idling control valve to the target valve opening amount if the throttle opening amount reaches the specified reference opening amount (θ ref2) in the non-idling state.

According to the present invention, throttle opening amount θ th reaches a reference opening amount (θ ref2) and intake air amount through the throttle valve is increased, and as a result, of the total intake air amount the proportion of intake air though the bypass passage becomes small, and there is no transition to open loop control unless variation in intake air amount through the bypass passage no longer has any substantial effect on engine speed. Therefore, even if there is a large difference between intake air amount calculated in feedback control and intake air amount calculated in open loop control, it is possible to smoothly change from feedback control to open loop control.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
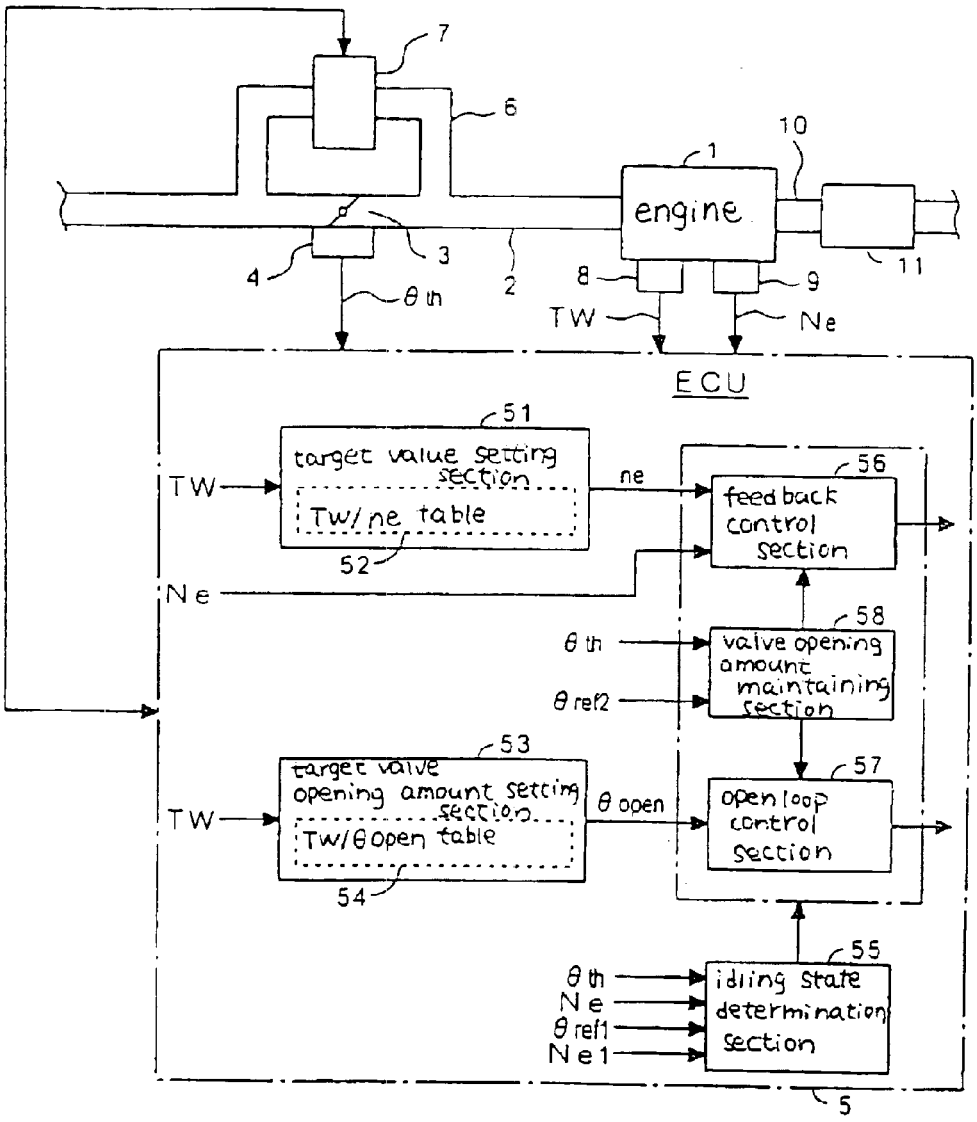
FIG. 1 is a block diagram showing the main structure of a vehicle in which the idle speed control device of the present invention is mounted.

A detailed description will now be given of preferred embodiments of the present invention with reference to the drawings. FIG. 1 is a block diagram showing the main structure of a vehicle in which the idle speed control device of the present invention is mounted, and shows only the structure essential for description of the invention, with the remaining structure being omitted.

A throttle valve 3 is provided in an intake pipe 2 of an engine 1. Opening amount (throttle opening amount) θ th of the throttle valve 3 is detected by a throttle opening amount sensor 4, and notified to an engine control unit (ECU) 5. A bypass passage 6 bypassing the throttle valve 3 is also connected to the intake pipe 2, and midway along the bypass passage 6 there is provided an idling control valve (IACV) 7 for controlling intake air amount at the time of idling.

The IACV 7 comprises a pulse motor and a control valve opened and closed by the pulse motor. The valve open amount of the control valve is controlled by a number of pulses supplied from the ECU 5 to the pulse motor, and as a result intake air amount at the time of idling, when intake to the engine 1 is through the bypass passage 6, is controlled. That is, idle speed is controlled. A water temperature sensor 8 is attached to the body of the engine 1, and cooling water temperature TW circulating inside the body of the engine 1 is detected and notified to the ECU 5. Engine speed Ne is detected by an engine speed sensor 9 and notified to the ECU 5. A muffler 11 is connected to an exhaust pipe 10 of the engine 1.

Figure 2:
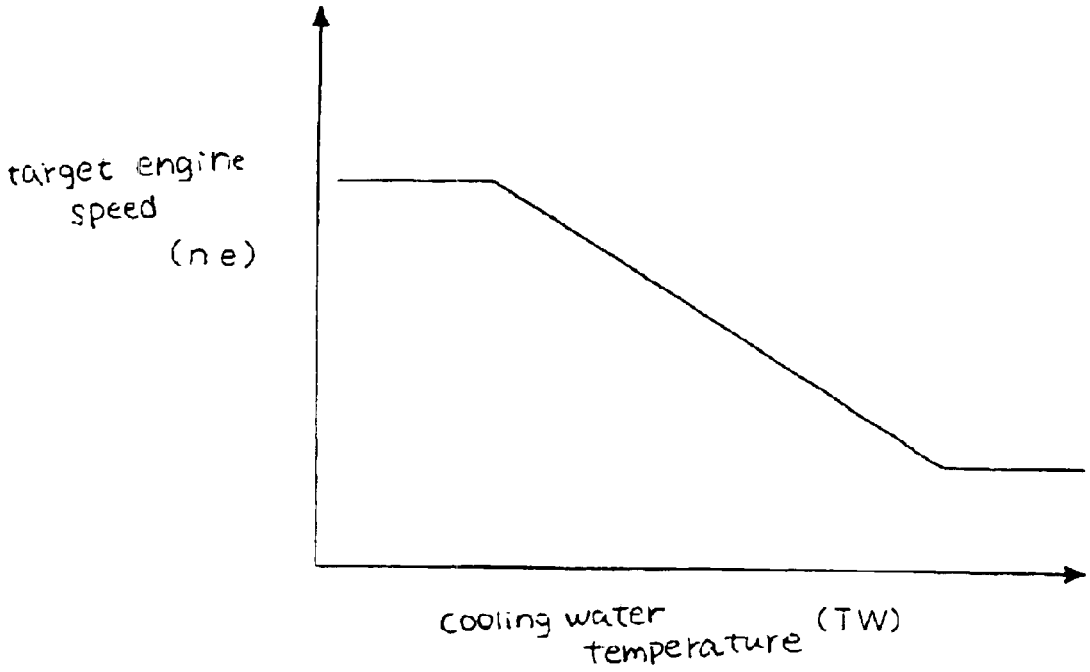
FIG. 2 shows one example of a cooling water temperature (TW) target engine speed (ne) table.
Figure 3:
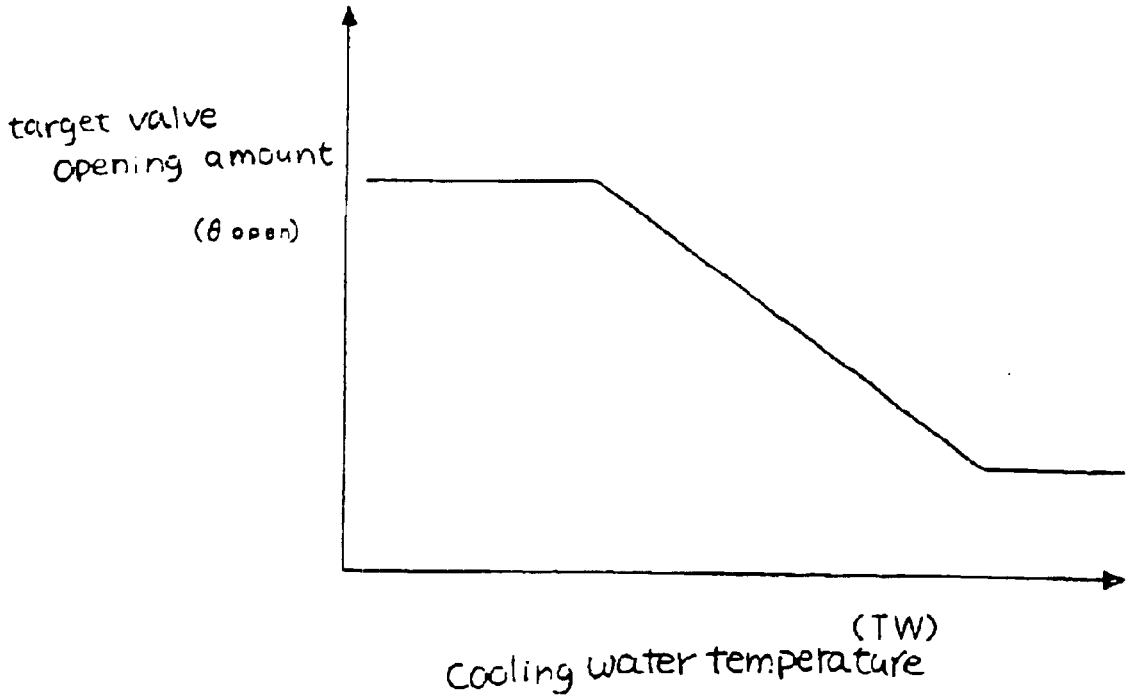
FIG. 3 shows one example of a cooling water temperature (TW) target valve opening amount (θ open) table.

In the ECU 5, a target value setting section 51 is provided with a cooling water temperature (TW)/target engine speed (ne) table 52, an example of which is shown in FIG. 2, and a target engine speed ne corresponding to the cooling water temperature TW is set by referring to the table 52 based on detected cooling water temperature TW. A relationship between cooling water temperature TW of the engine 1 and the target speed ne of the engine 1 in an idling state is stored in advance in the table 52. A target opening amount setting section 53 is provided with a cooling water temperature (TW)/target valve opening amount (θ open) table 54, an example of which is shown in FIG. 3, and a target valve opening amount (θ open) corresponding to the cooling water temperature TW is set by referring to the table 54 based on detected cooling water temperature TW. A relationship between cooling water temperature TW of the engine and the target valve opening amount θ open of the IACV 7 in a non-idling state is stored in advance in the second data table 54.

An idling state determination unit 55 compares throttle opening amount θ th detected by the throttle opening amount sensor 4 with a previously registered first reference opening amount θ ref1, and compares detected engine speed Ne with a previously registered first reference speed Ne1, and determines whether or not the engine 1 is in an idling state based on the comparison results. A feedback control section 56 feedback controls opening amount of the IACV 7 so that in an idling state the target engine speed ne obtained from the cooling water temperature TW and the current engine speed Ne coincide.

An open loop control section 57 carries out open-loop control of the IACV 7 so that the valve opening amount of the IACV in the non-idling state coincides with the target valve opening amount θ open. A valve opening amount maintaining section 58, when shifting from the idling state to a non-idling state, maintains the IACV 7 at the valve opening amount at the time of feedback control until the detected throttle opening amount θ th reaches a specified reference opening amount θ ref2.

Figure 4:
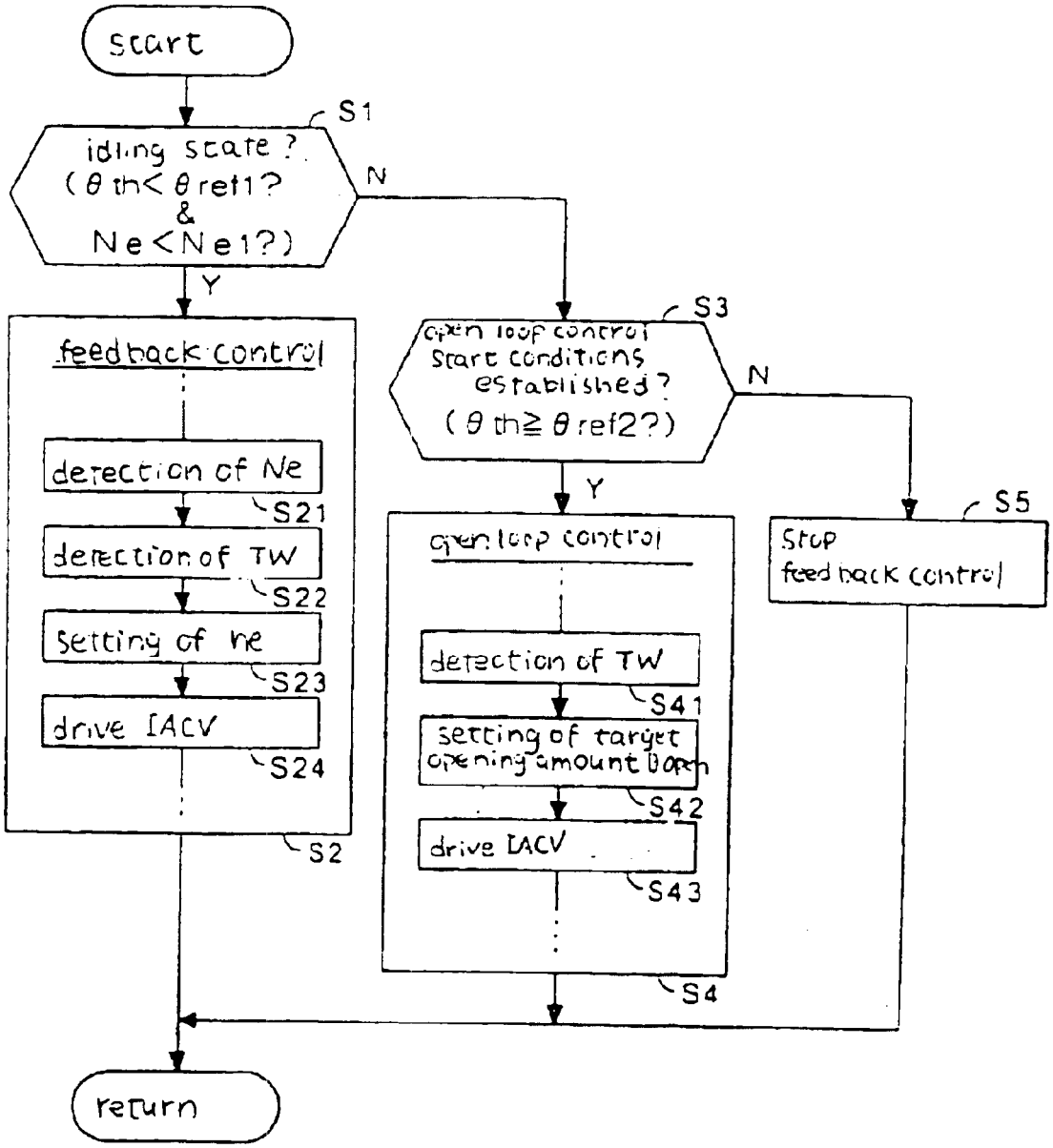
FIG. 4 is a flowchart showing operation of the present invention.
Figure 5:
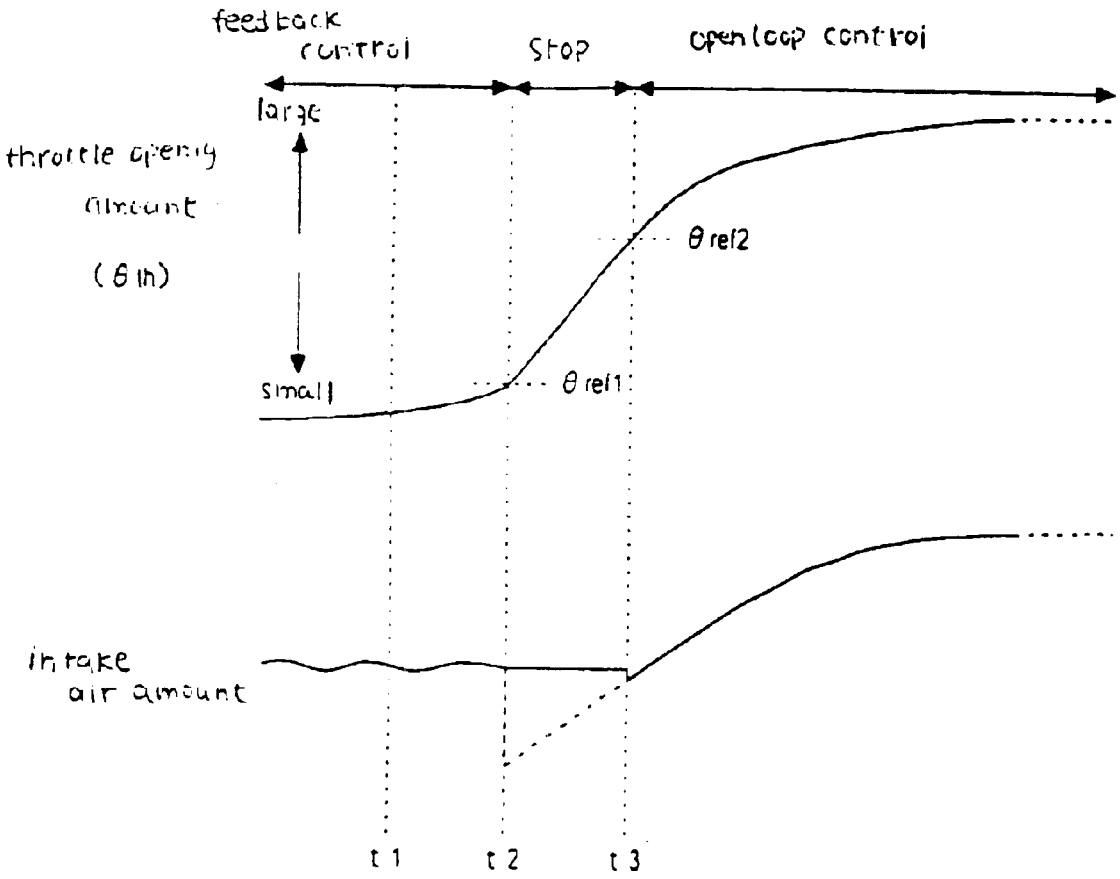
FIG. 5 is a timing chart showing operation of the present invention.
Figure 6:
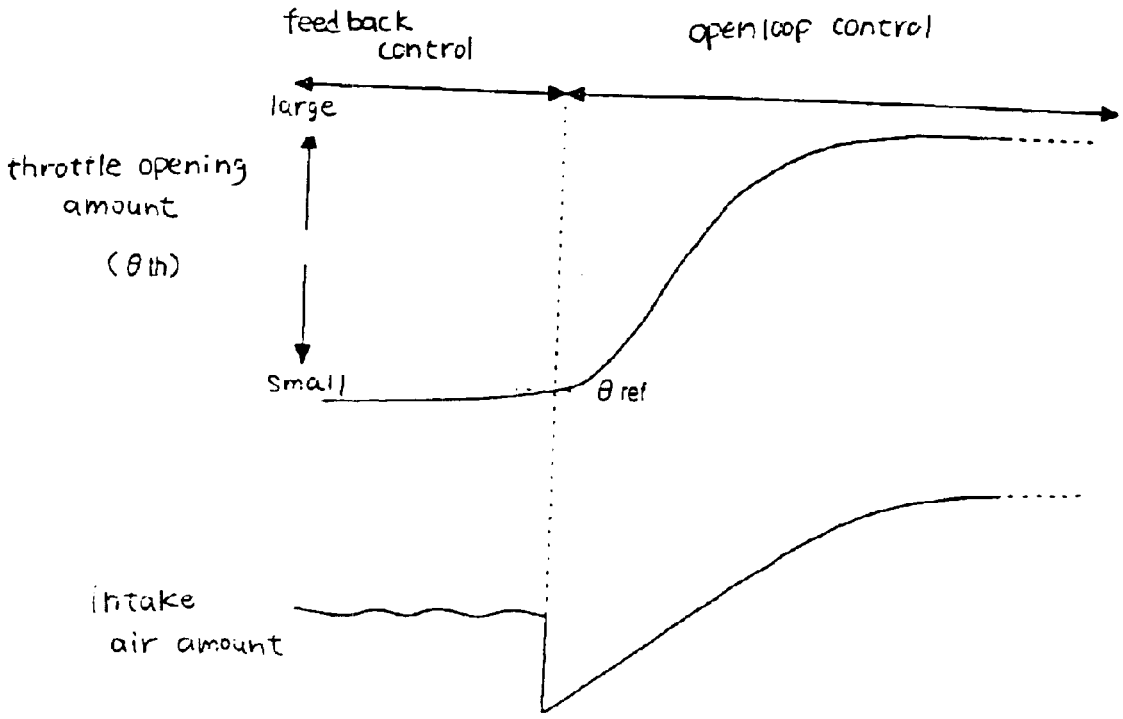
FIG. 6 BACKGROUND ART
FIG. 6 is a drawing for describing problems solved by the invention.

Next, operation of this embodiment will be described with reference to the flowchart of FIG. 4 and the timing chart of FIG. 5.

In step S1, in order to determine if the engine is in an idling state, in the idling state determination section 55 of the ECU 5, the current throttle opening amount θ th is compared with a first reference opening amount θ ref1, and the current engine speed Ne is compared with a first reference speed Ne1. In this embodiment, the first reference opening amount θ ref1 is set slightly more open than a fully opened or closed amount, and the first reference speed Ne1 is set to slightly faster than an idling speed, which means that if θ th<θ ref1 and Ne<Ne1, as from time t1–t2 in FIG. 5, an idling state is determined and processing advances to step S2.

In step S2, feedback control to control valve opening amount of the IACV 7 so that the engine speed Ne and the target engine speed ne coincide is executed by the feedback control section 56. Also, described more specifically, in step S21 current engine speed Ne is detected, and in step S22 engine cooling water temperature TW is detected. In step S23, a target engine speed ne is obtained based on the TW/ne table 52 and detected cooling water temperature TW. In step S24, the IACV 7 is open and close controlled so that the current engine speed Ne and the target engine speed ne coincide.

After that, at time t2 the throttle opening amount θ th reaches the first reference opening amount θ ref1, or the engine speed Ne reaches the first reference speed Ne1, and if this is detected in step S1, a non-idling state is determined and processing advances to step S3. In step S3, whether or not start conditions for open loop control have been established is determined by the valve opening amount maintaining section 58. In the valve opening amount maintaining section 58, the current throttle opening amount θ th and the second reference opening amount θ ref2 are compared, and if θ th≦θ ref2, as from time t2–t3, it is determined that start conditions for open loop control have not been established and processing advances to step S5. At step S5, stop of feedback control is instructed to the feedback control section 56, and after that the processing for this time is completed. Therefore, valve opening amount of the IACV 7 is maintained at the final (newest) valve opening amount at the time of feedback control.

After that, at time t3 the throttle opening amount θ th exceeds the second reference opening amount θ ref2, and if this is detected in step S3, processing advances to step S4. At step S4, open loop control is executed so that the valve opening amount of the IACV 7 coincides with the target valve opening amount θ open obtained based on engine cooling water temperature TW.

Also, described more specifically, in step S41 engine cooling water temperature TW is detected. In step S42, a target valve opening amount θ open for open loop control is obtained based on the TW/θ open table 54 and detected cooling water temperature TW. In step S43, the IACV 7 is driven so that opening amount of the IACV 7 coincides with the target valve opening amount θ open.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An idle speed control device, for controlling rotational speed of an engine in an idling state to a target value, comprising:

a bypass passage for bypassing a throttle valve;

an idle control valve provided in the bypass passage;

a throttle opening amount sensor for detecting throttle opening amount; and control means for controlling opening amount of the idling control valve;

wherein the control means further comprises:

means for determining whether the engine is in an idling state or a non-idling state;

means for obtaining a target speed for engine rotational speed in the idling state;

means for obtaining a target valve opening amount for the idling control valve in the non-idling state;

feedback control means for controlling the idling control valve so that the engine rotation speed matches the target value in the idling state;

valve opening amount maintaining means for, when shifting from the idling state to a non-idling state, maintaining the idling control valve at the opening amount at the time of feedback control until the throttle opening amount reaches a specified reference opening amount; and open loop control means for controlling the idling control valve to the target valve opening amount if the throttle opening amount reaches the specified reference opening amount in the non-idling state.

2. The idle speed control device of claim 1, wherein the valve opening amount maintaining means stops feedback control when shifting from the idling state to the non-idling state.

3. The idle speed control device of claim 1, further comprising:

means for detecting engine rotation speed;

means for detecting engine cooling water temperature;

first storage means for establishing a relationship between cooling water temperature and engine target rotational speed; and second storage means for establishing a relationship between cooling water temperature and idling control valve target opening amount;

wherein the means for obtaining a target value for engine rotation speed obtains a target value for engine rotational speed based on detected cooling water temperature and the first storage means, while the means for obtaining idling control valve target valve opening amount obtains the target valve opening amount based on detected cooling water temperature and the second storage means.

4. The idle speed control device of claim 2, further comprising:

means for detecting engine rotation speed;

means for detecting engine cooling water temperature;

first storage means for establishing a relationship between cooling water temperature and engine target rotational speed; and second storage means for establishing a relationship between cooling water temperature and idling control valve target opening amount;

wherein the means for obtaining a target value for engine rotation speed obtains a target value for engine rotational speed based on detected cooling water temperature and the first storage means, while the means for obtaining idling control valve target valve opening amount obtains the target valve opening amount based on detected cooling water temperature and the second storage means.

5. The idle speed control device of claim 3, wherein a relationship between the cooling water temperature of the engine and the target speed of the engine 1 in an idling state is stored in advance in the first storage means.

6. The idle speed control device of claim 3, wherein a relationship between the cooling water temperature of the engine and the target valve opening amount open of the idle control valve in a non-idling state is stored in advance in the second storage means.

7. The idle speed control device of claim 1, wherein the means for determining whether the engine is in the idling state compares the throttle opening amount detected by the throttle opening amount sensor with a previously registered first reference opening amount, and compares a detected engine speed with a previously registered first reference speed, and determines whether or not the engine is in the idling state based on the comparison results.

8. The idle speed control device of claim 1, wherein the feedback control means controls the opening amount of the idle control valve so that in the idling state the target engine speed obtained from a cooling water temperature and a current engine speed coincide.

9. A method of controlling idle speed of an engine, comprising the steps of:

determining if the engine is in an idling state;

if the engine is determined to be in the idling state, executing feedback control to control a valve opening amount of an idle control valve;

if the engine is determined to be not in the idling state, determining whether or not start conditions for open control loop have been established;

if the start conditions have been established, executing open loop control so that the valve opening amount of the idle control valve coincides with a target valve opening amount obtained based on an engine cooling water temperature; and if the start conditions have not been established, stopping the feedback control.

10. The method of controlling idle speed of an engine according to claim 9, wherein the step of executing feedback control includes the steps of:

detecting a current engine speed;

detecting the engine cooling water temperature;

obtaining a target engine speed based on a first predetermined value stored in a first table; and controlling opening and closing of the idle control valve so that the current engine speed and the target engine speed coincide.

11. The method of controlling idle speed of an engine according to claim 9, wherein the step of executing loop control includes the steps of:

detecting the engine cooling water temperature;

obtaining the target valve opening amount for the open loop control based on a second predetermined value stored in a second table and the detected cooling water temperature; and driving the idle control valve so that the opening amount of the idle control valve coincides with the target valve opening amount.

* * * * *